US005213321A

United States Patent [19]

Stobb

[11] Patent Number: 5,213,321

[45] Date of Patent: May 25, 1993

[54] HOPPER LOADER FOR TRANSPORTING SHEETS IN AN EDGE-STANDING ARRANGEMENT, AND METHOD THEREFOR

[76] Inventor: Walter J. Stobb, P.O. Box 5205, Clinton, N.J. 08809

[21] Appl. No.: 744,405

[22] Filed: Aug. 13, 1991

[51] Int. Cl.[5] ..... B65H 1/02

[52] U.S. Cl. ..... 271/149; 271/150; 271/157; 271/162

[58] Field of Search ..... 271/150, 149, 157, 162, 271/127

[56] References Cited

U.S. PATENT DOCUMENTS

| | | | |
|---|---|---|---|
| 4,177,982 | 12/1979 | Bewersdorf et al. | 271/150 X |
| 4,588,180 | 5/1986 | Ballestrazzi et al. | 271/5 |
| 4,618,054 | 10/1986 | Muller | 198/409 |
| 4,618,136 | 10/1986 | Pessina et al. | 271/150 |
| 4,819,929 | 4/1989 | Stobb | 271/172 |
| 4,981,292 | 1/1991 | Cosgrove | 271/157 X |

*Primary Examiner*—David H. Bollinger
*Attorney, Agent, or Firm*—Arthur J. Hansmann

[57] ABSTRACT

A hopper loader for transporting sheets in an edge-standing arrangement and having a pivotal module for loading the sheets therein. The pivotal module is then pivoted downwardly to a horizontal position to align with another module which receives the sheets and continues to move the sheets to their destination.

16 Claims, 6 Drawing Sheets

HOPPER LOADER FOR TRANSPORTING SHEETS IN AN EDGE-STANDING ARRANGEMENT, AND METHOD THEREFOR

This invention relates to a hopper loader for transporting sheets in an edge-standing arrangement, and method therefor. More particularly, it relates to a continuous conveyor for transporting edge-standing sheets to a hopper and wherein the conveyor includes an entry section which is pivotal downwardly for loading sheets thereon and then pivotal upwardly to convey the sheets along the entire conveyor.

BACKGROUND OF THE INVENTION

Hopper loaders for conveying sheets in an edge-standing arrangement and to a hopper are already known in the prior art. One example is shown in my U.S. Pat. No. 4,819,929 wherein there is an extended conveyor for supporting sheets in the edge-standing arrangement and advancing those sheets into the hopper. In that conveyor construction, the sheets are initially loaded onto the conveyor, such as by hand or overhead crane or like loading activity. In all known instances, the sheets are set onto a fixed horizontal entry conveyor section and they are then advanced toward the hopper loader. That prior art arrangement requires that the sheets be manually lifted, or otherwise mechanically deposited, onto the conveyor entry section which is above the floor level at a significant elevation and thus it requires considerable lifting or hoisting.

The present invention improves upon the prior art in that it provides for the conveyor entry section to be pivotal downwardly to where the new supply of edge-standing sheets can be easily and readily placed onto the entry section which is subsequently pivoted upwardly for moving the new supply of sheets along the entire conveyor and into the hopper. Accordingly, this reduces the manual effort, in the manual loading system, and it eliminates the need for any mechanical device required for lifting the entire bundle or supply of new sheets to a significant elevation and then depositing those sheets into the entry section.

Further, the present invention also improves upon the prior art in that the supply sheets can be positioned on the pivotal entry section without requiring that the sheets be specially jogged for alignment of the sheets in the feeder conveyor. In this regard, the pivotal entry section of the conveyor includes upright and opposite side edge supports for the sheets for both the alignment and upright retention of the opposite edges when the sheets are positioned in the entry section and when they are conveyed therealong.

Still further, the pivotal entry section of this invention is of a modular type design which is arranged with two pivot axes spaced along its length so that the module can be pivoted, relative to the remainder of the conveyor, at either pivot axis to thereby determine the extent of modules from its pivot axis and downward toward the floor, all for accommodating conveyors disposed at either a low or a high elevation relative to the floor.

Still further, the entry conveyor section of this invention is arranged so that it can receive bound bundles of sheets, and it can do so through the manual loading described because the pivotal section is pivoted downwardly adjacent the floor, and the section is arranged to accommodate release and removal of the binding strap after the bundle is placed into the entry section.

Still further, the entry section of this invention is arranged with a sheet conveyor which aligns with the sheet conveyor of the remainder of the hopper loader conveyor, and thus the new supply of sheets positioned in the entry section are readily and accurately advanced into the remainder of the conveyor for movement toward the hopper.

Other prior art hopper loaders or the like are shown in U.S. Pat. Nos. 4,588,180 and 4,618,136. However, those two patents show only upstanding signature conveyors which do not have any pivotal module sections for loading, as in this invention, and differ from this invention as mentioned above.

Additionally, U.S. Pat. No. 4,618,054 shows sheet-handling equipment with a pivotal section at the outlet end of a conveyor, and it is therefore not a pivotal section for loading sheets onto a conveyor and wherein the pivotal section has its own conveyor which matches with that remainder portion of the complete conveyor, as in the present invention. Also, the aforesaid advantages also distinguish the present invention over this patent.

The herein method of handling edge-standing sheets is also novel.

DETAILED DESCRIPTION OF THE EMBODIMENT AND METHOD OF THIS INVENTION

Figure 1:
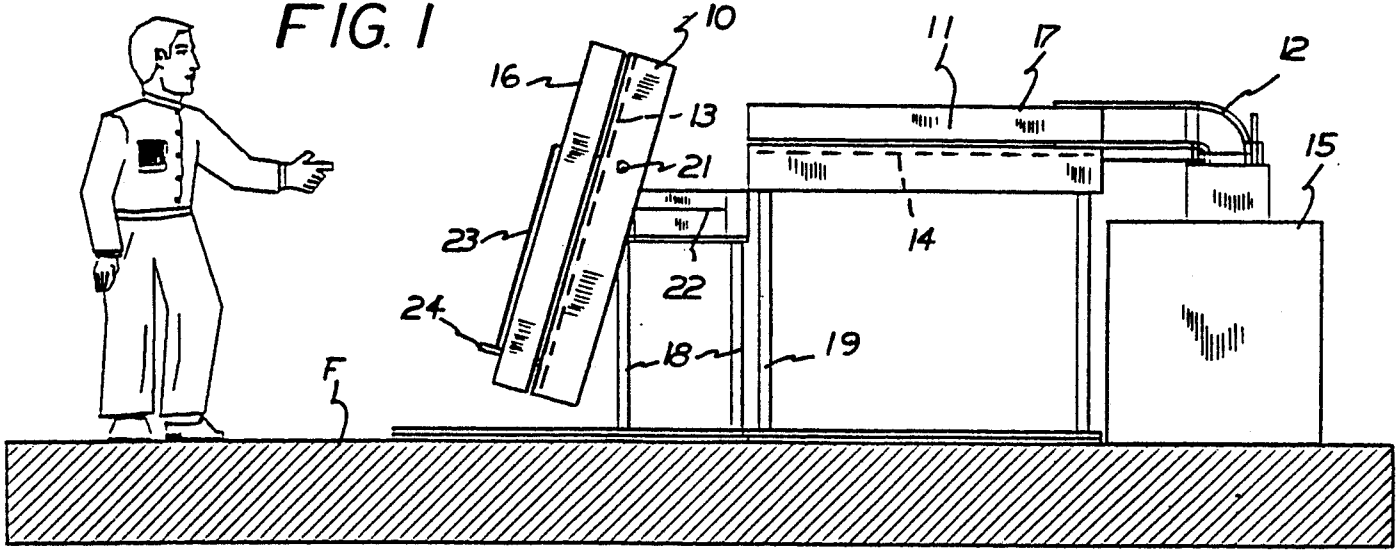
FIGS. 1 through 4a are side elevational views of the apparatus of this invention, in various stages of operation.

FIG. 1 shows one arrangement of the apparatus of this invention, and showing it relating it to the depiction of an operator standing on the floor F. The apparatus includes a first section 10 and a second section 11 and a third section 12. The section 12 is shown to be a hopper loader which feeds sheets of paper to a hopper 15 for collating or the like, all in the standard practice of the graphic arts industry and well understood by anyone skilled in the art. In actuality, sections 11 and 12 are similar to the apparatus shown in my U.S. Pat. No. 4,819,929 where sheets are transported in upstanding position and past side supports or guides and into a sheet gatherer.

Sections 11 and 12 have floors 13 and 14 which extend along the length and width of the respective sections 10 and 11 for uprightly supporting the sheets on their upstanding edges, as disclosed in my aforesaid patent and as shown herein. Also, in similarity with the aforesaid patent, the sections 11 and 12 have sheet side supports 16 and 17 which are spaced apart and which engage the opposite side edges of the upstanding sheets for supporting them uprightly while they are slid along the floors 13 and 14.

The modules or sections 10 and 11 are supported above the floor by means of table legs 18 and 19, and thus they are at a convenient height for the operator. However, in order to avoid the necessity for the operator to lift the sheets into the initial module or section 10, the section 10 is shown to be mounted on a pivot mounting 21 on the pedestal or leg 18 which support a super structure 22 for the actual connection of the module 10 with the structure 22 and through the pivot mounting 21.

Figure 2:
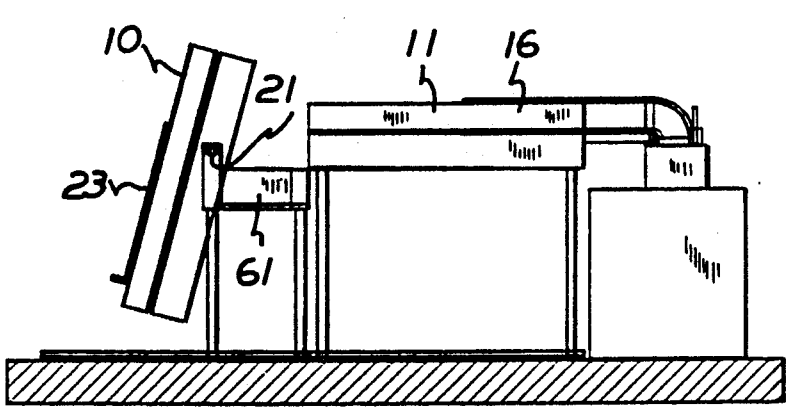
Figure 5:
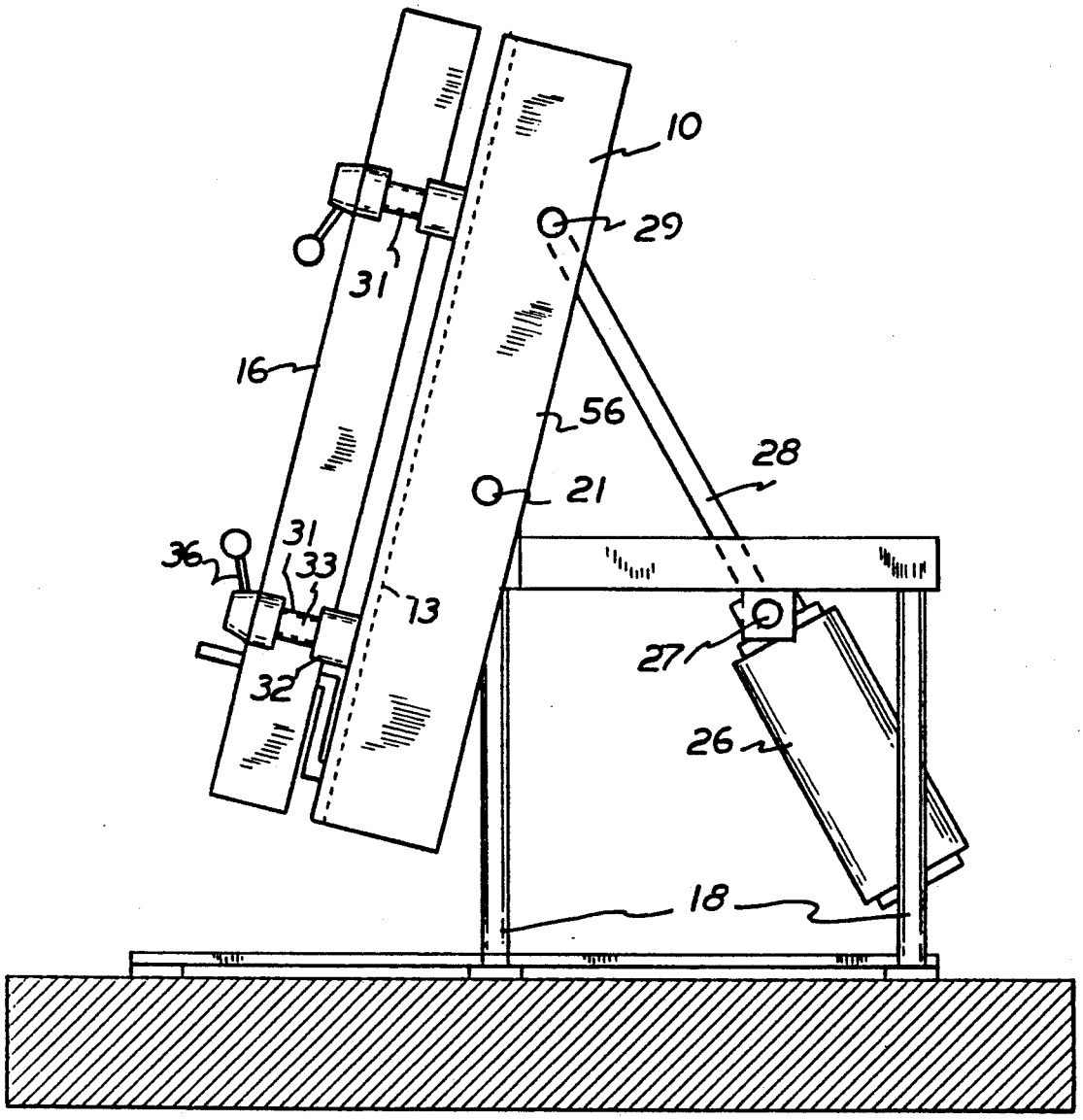
FIG. 5 is a side elevational view of apparatus of this invention, and showing a portion of previous figures, with parts added thereto.

In the pivoted orientation shown in FIGS. 1, 2, and 5, the operator can readily lift and position the bundle of sheets 23 into the section 10 and between the spaced-apart side supports 16. Of course the bundle 23 rests on the floor 13, and there is a backstop 24 which also upwardly supports the bundle 23 in the FIG. 1 position of the section 10.

That is, with the section 10 pivoted to the position shown in FIG. 1, the operator can load the bundle 23 into the module 10 rather than lift the entire bundle to the elevation of the floor 14 which is the destination for the sheets in the bundle 23.

FIGS. 2 through 4*a* show the sequence of the disposition of the bundle 23, and FIG. 2 shows the module 10 in the position shown in FIG. 1, and that is when the bundle 23 is initially loaded into the module 10. Next, the module 10 is pivoted to the horizontal orientation shown in FIG. 3, and the bundle 23 is still in contact with the pusher 24. Also, it will now be seen that the module floors 13 and 14 are on the same plane and are therefore aligned so that the bundle 23 can be slid along the floor 13 and directly onto the floor 14.

Figure 4A:
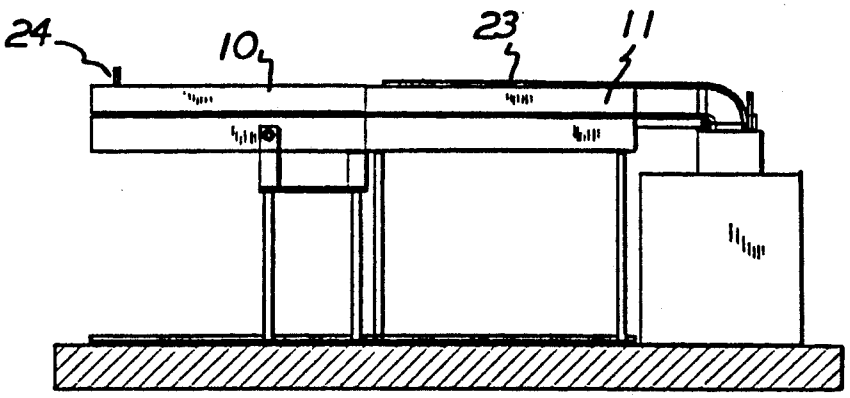
Figure 4:
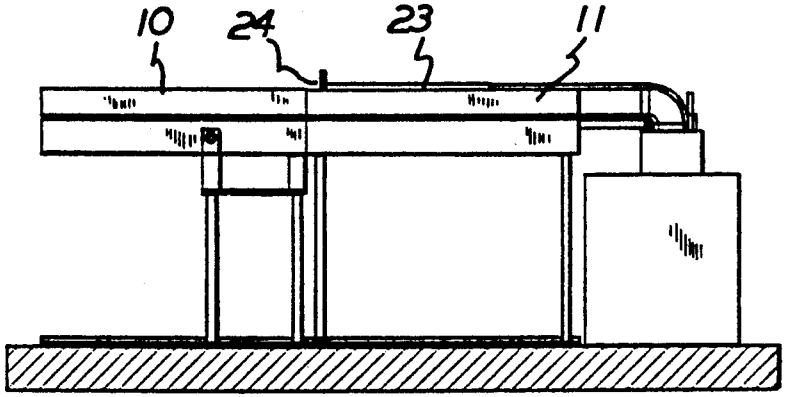

FIG. 4 shows that the bundle 23 has been slid onto the module 11 by means of the pusher 24 having been advanced rightwardly from the FIG. 2 position. Finally, as seen in FIG. 4*a*, the bundle 23 remains in the module 11 while the pusher 24 is retracted to its initial or load position shown in FIGS. 1, 2, and 3. At that time, the bundle 23 is completely free of the module 10 but is under the influence of the module 11 which has its own conveyor system for moving the bundle 23 toward the gatherer 15, such as described in my U.S. Pat. No. 4,819,929 which is made a part of this disclosure, as needed.

FIG. 5 shows the module 10 pivoted upwardly to the loading position of FIGS. 1 and 2, and it does show the module 10 having its pivot mounting 21 more central with respect to the length of the floor 13. This loading position is shown in FIGS. 1, 2, and 5 to have the plane of the floor 13 substantially vertical in that it is shown to be between 15 and 20 degrees of angulation with the vertical. Thus the loading position is defined as having the longitudinal plane of the floor 13 being closer to vertical orientation than to the horizontal orientation. Also shown, in that loading position, is that the sheets 23 are in a reclining position and are supported by the pusher 24. Also, a fluid cylinder 26 is shown pivotally mounted on the structure 22 by means of a pivot pin 27, and its piston rod 28 extends upwardly to the module 10 to where a pivot pin 29 connects therewith. In that arrangement, the fluid cylinder assembly described is suitable for pivoting the module 10 between the FIG. 5 position and the horizontal or FIG. 3 position. Of course the fluid assembly is adequate in length to accomplish the pivot mentioned, and it is also a two-way acting assembly for pivoting the module 10 up and down.

Figure 10:
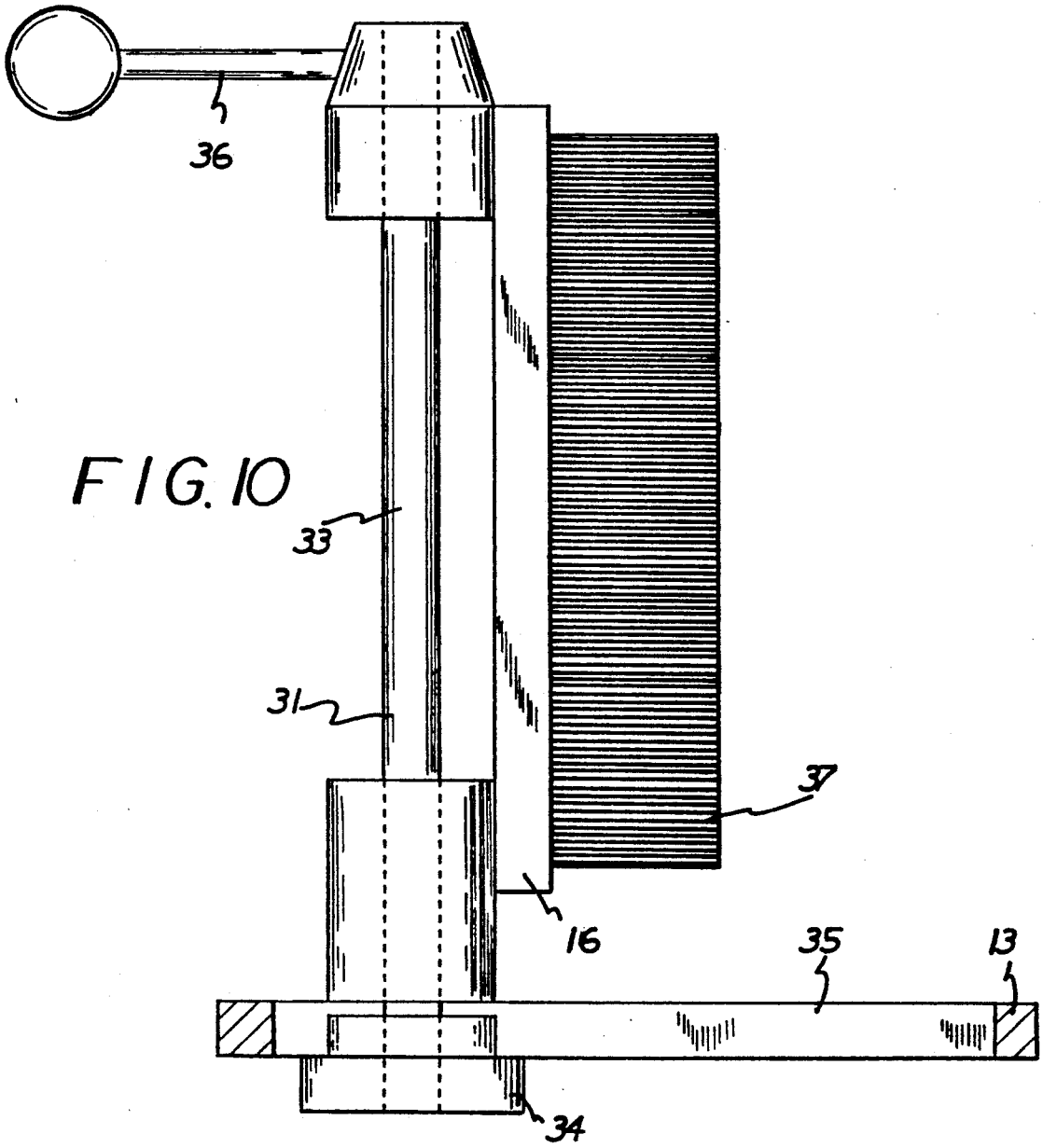
FIG. 10 is an enlarged end elevational view of a portion of the apparatus shown in FIG. 5.

FIG. 5 also shows adjustable mounting assemblies 31 which are mounted on the table 13 and which support the two spaced-apart sheet opposite side supports 16. As with my U.S. Pat. No. 4,819,929, the side support 16 can be brushes which can be moved toward and away from each other through the adjustable supports 31. Each support 31 has a bushing 32 which slides into a slot 35 in the table 13, as seen in FIG. 10. The adjusting mechanisms 31 therefore slide across the table to move the spaced-apart support 16 toward and away from each other in accordance with the width of the sheets in the bundle 23. A mechanism shaft 33 is threaded and can thread into a nut 34 on the under side of the table 13, and a handle 36 connects with the upper end of the shaft 33 for rotating the shaft and thereby tightening and loosening the mechanism 31 relative to the table 13. FIG. 10 also shows the brush 37 which is secured to the upper and lower ends of the mechanism 31, and thus the extending ends of the brush bristles present themselves to the opposite side edges of the sheets in the bundle 23.

In the arrangement described, the sheets in the bundle 23 remain in the upright position while they are slid along the floor 13 by means of the rightward movement of the pusher 24, as shown in these views.

Figure 7:
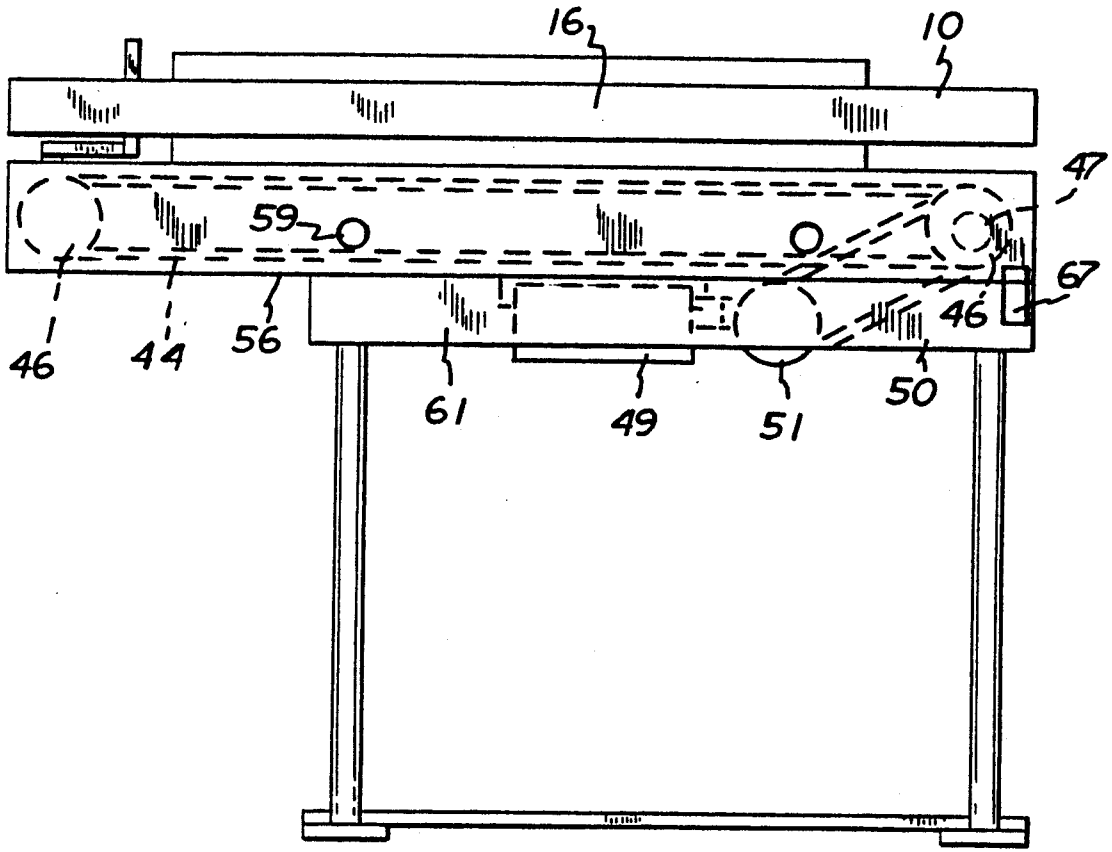
FIGS. 6 and 7 are end and side elevational views, respectively, of apparatus of this invention, and further displaying the apparatus of FIG. 5.
Figure 6:
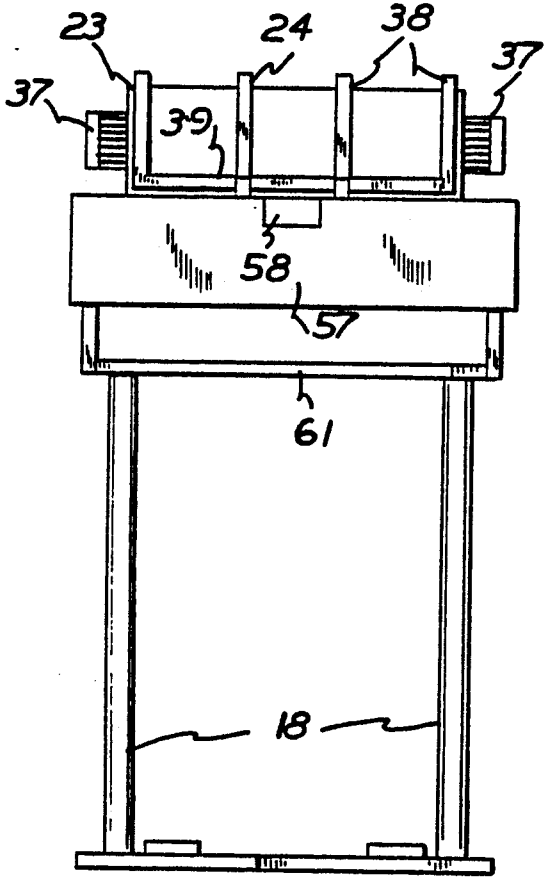
Figure 8:
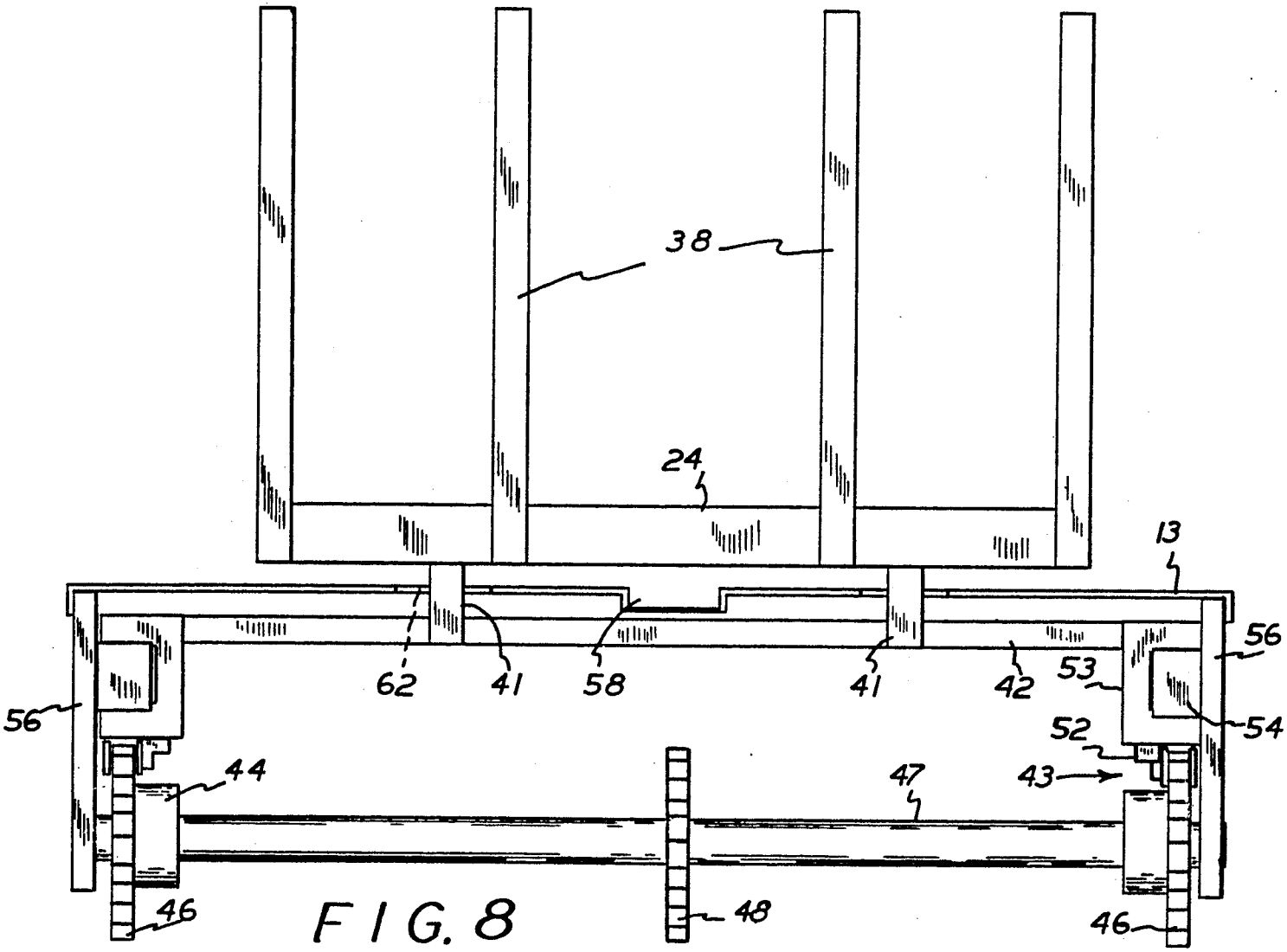
FIG. 8 is an enlarged end elevational view of certain parts of the apparatus of the previous figures, with parts removed and parts added thereto.

FIG. 6 shows the end view of the pusher 24 and it shows the bundle 23 flanked by the side brushes 37. The pusher is shown to have upstanding tines 38 interconnected by a crosspiece 39. Two arms 41 are connected to the crosspiece 39 and also to a crosspiece 42 which is part of a conveyor or pusher system for moving the pusher 24 rightwardly and leftwardly, as described. FIGS. 7 and 8 show the conveyor 43 to include a conventional chain 44 trained about two spaced-apart sprockets 46 suitably rotatably supported on the module 10. FIG. 8 shows that the sprockets 46 are on a sprocket shaft 47 which also has a drive sprocket 48. FIG. 7 shows that there is a motor 49 with a sprocket 51 which is also drivingly connected with the drive sprocket 48 for rotating the shaft 47 and thus rotating the sprockets 46 and thereby displacing the chain 44 to move the pusher 24. The pusher 24 is of course connected to the chain 44, such as by means of a connecting link 52 of FIG. 8, and those links 52 are connected to C-shaped sliding blocks 53 which nest with a slide guide 54 affixed to the upright sides 56 of the module 10. At this time it will be noted that FIG. 8 shows the end view of the mechanism just described, and the back panel 57 of the module 10, as seen in FIG. 6, has been removed for purposes of displaying the mechanism in FIG. 8.

It will therefore be understood that the motor 49 and its sprocket 51 are suitably mounted on the module 10 to pivot up and down therewith, along with the pivot action of the side plates 56 which are supporting the floor 13 of the module 10. In that manner, the motor 49 motivates the chain 44 to position the pusher 24 in any pivoted position of the module 10, since the assembly is unitary, as described. Also, sprocket 51 is connected to sprocket 48 through a chain 50.

Figure 9:
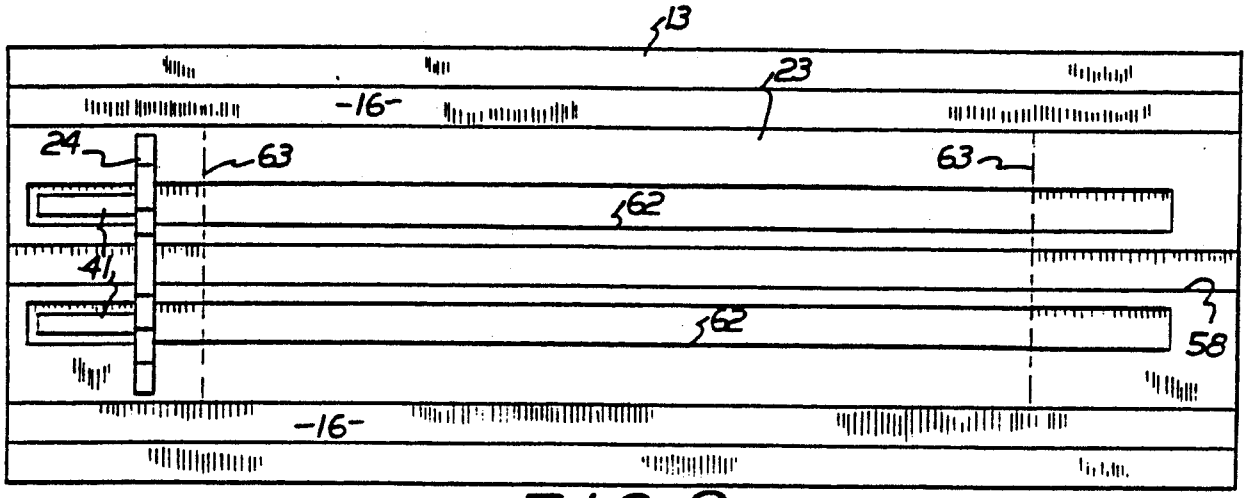
FIG. 9 is an enlarged plan view of a portion of the apparatus shown in FIGS. 6 and 7.
Figure 3:
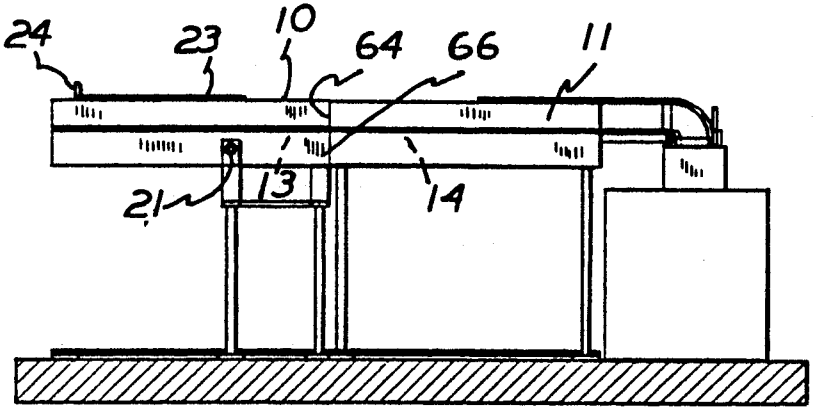

FIGS. 8 and 9 also show that the table 13 has a central depression 58 extending the length of the table 13, and this is available for removal of a central strap which normally binds the bundle 23 prior to loading the bundle onto the module 10. That is, after the bundle is loaded onto the module 10, then the strap can be cut and slipped out from under the bundle through the slot 58 so that the sheets in the bundle 23 are then freestanding sheets guided by the side supports or brushes 37.

In the arrangement described, the method is also inherently described. It will be understood that the module 10 can be pivotally supported anywhere along its lengths, such as toward one end of FIG. 2 and toward the other end in FIG. 7 where the pivot mounting 59 is shown. The placement of the pivot mounting 21 or 59 of course determines the positioning of the module 10 in the upright and also horizontal positions to accommodate various conditions and reach of the module 10 toward the floor or the like. FIGS. 6 and 7 also show how the pedestal or floor support can be arranged by utilization of an upright U-shaped support 61 standing on the legs 18 and engaging the lower edges of the side plates 56 and the end plate 57. Of course the plates 56 and 57 are suitably pivotally mounted on the support structure 61 to accomplish the pivoting described. Support 61 is part of pedestal 22.

Also, FIG. 9 shows the plan view of the table 13 where the side supports 16 are seen spaced apart and extending the length of the table 13. Two longitudinal and spaced-apart openings 62 extend through the table 13 to accommodate the arms 41 of the pusher 24 and thereby permit the movement of the pusher 24 along the length of the table 13, as described. FIG. 9 also shows in dot-dash lines 63 the ends of the bundle 23 which is shown spaced from the pusher 24, for clarity of showing the outline of the bundle 23.

The modules 10 and 11 are therefore related so that the module 10 can be pivoted and have its floor 13 aligned with the floor 14 of the module 11 for the smooth transport of the sheets moving from module 10 onto module 11. With that arrangement, the operator need not lift the bundle 23 up to the elevation of the module 11, and the sheets are continuously moving into the hopper 15, without any interruptions, because the operator can always load the module 10 and move the sheets into the module 11 where its own conveyor will transport the sheets while the operator is again loading the module 10, as needed. In this arrangement, the module 10 has its sheet outlet end 64 adjacent to and aligned with the sheet inlet end 66 of the module 11, and these outlet and inlet ends are in sheet-flow communication even though the module 10 is pivotal for loading, as described.

Further, as seen in FIG. 5, either pivot mounting 21 or 29 could be the pivot mounting of the module 10 on its pedestal, and the other of the mountings 21 and 29 could then be the connection for the cylinder assembly. In this description, the pusher 24 is actually a conveyor, and the module 11 has its own conveyor, as mentioned.

In the FIG. 1 arrangement, the pivot mounting 21 is shown relative to the length of the module 10. A latch 67 as shown in FIG. 7 can extend between the pedestal and the module 10 for restraining the upright pivoting or tipping of the module 10 when it is overbalanced to the left of the pivot mounting 21 as viewed in FIG. 1 but of course is in the horizontal position.

The pusher 24 has its arms 41 offset from the upright plane of the fingers 38 so that the fingers 38 can convey the sheets 23 onto the module 11 without leaving the module 10. That is, the offset is sufficient to permit the arms 41 to remain in the table slots 63 while positioning the fingers 38 over the table 14, where the unshown, but conventional, conveyor in module 11 controls the sheets 23.

What is claimed is:

1. A hopper loader for transporting sheets in an edge-standing arrangement, comprising a sheet-supporting first section horizontally disposed and having a sheet inlet end and having a floor for supporting the sheets on edge, a sheet-supporting second section pivotally mounted adjacent said first section and having a floor for supporting the sheets on edge and being pivotal between a downward sheet-loading position and an upward horizontal position with its said floor planar with said floor of said first section in said upward position, powered pivot means connected to said second section for the aforesaid pivoting, said second section having a sheet outlet end aligned with said sheet inlet end of said first section for the movement of the edge-standing sheets off said floor of said second section and onto said floor of said first section.

2. The hopper loader for transporting sheets in an edge-standing arrangement, as claimed in claim 1, including a sheet conveyor mounted on said second section for moving the edge-standing sheets to said first section.

3. The hopper loader for transporting sheets in an edge-standing arrangement, as claimed in claim 1, including a sheet conveyor mounted on said first section for moving the edge-standing sheets along said first section.

4. The hopper loader for transporting sheets in an edge-standing arrangement, as claimed in claim 3, wherein said sheet conveyor on said second section is an upstanding pusher member engaged with the sheets and being movable along said floor of said second section for moving the sheets through said outlet end.

5. The hopper loader for transporting sheets in an edge-standing arrangement, as claimed in claim 1, including securing means connected to said second section for releasably holding said second section in said horizontal position.

6. The hopper loader for transporting sheets in an edge-standing arrangement, as claimed in claim 1, including spaced-apart supports in both said sections for engaging the upstanding opposite edges of the sheets and thereby control the upstanding position of the sheets.

7. The hopper loader for transporting sheets in an edge-standing arrangement, as claimed in claim 1, including a support pedestal having a pivot mounting for supporting said second section horizontally at a datum level, and said second section including two pivot connections spaced apart along said second section in the direction of said first section, for selective pivotal mounting of said second section onto said support pedestal by means of one of said two pivot connections to thereby selectively extend said second section below said datum level when said second section is in said downward position.

8. The hopper loader for transporting sheets in an edge-standing arrangement, as claimed in claim 7, including securing means connected to said second section for releasably holding said second section in said horizontal position.

9. The hopper loader for transporting sheets in an edge-standing arrangement, as claimed in claim 8, including spaced-apart supports in both said sections for engaging the upstanding opposite edges of the sheets and thereby control the upstanding position of the sheets.

10. In a hopper loader for transporting sheets in an edge-standing arrangement, a first sheet-supporting conveyor for movably supporting sheets on edge and having a sheet inlet end, the improvement comprising a second sheet-supporting conveyor pivotally mounted adjacent said inlet end of said first sheet-supporting conveyor and being pivotal to a declining orientation relative to said first sheet-supporting conveyor, for receiving the deposit of sheets onto said second sheet-supporting conveyor, and being pivotal to a non-declining orientation relative to said first sheet-supporting conveyor, for transporting movement to convey the sheets on said second sheet-supporting conveyor into said inlet end of said first sheet-supporting conveyor, and a movable backstop upstanding on said second sheet-supporting conveyor for upwardly supporting the sheets thereon when in the declining orientation, and said backstop being progressively movable along with the movement of said second sheet-supporting conveyor for support of said sheets in the non-declining orientation also.

11. The hopper loader for transporting sheets in an edge-standing arrangement, as claimed in claim 10, including pivot means connected to said second sheet-supporting conveyor for pivoting said second sheet-supporting conveyor for pivoting said second sheet-supporting conveyor between said declining and non-declining orientations.

12. The hopper loader for transporting sheets in an edge-standing arrangement, as claimed in claim 10, including spaced-apart supports in both said conveyors for engaging the upstanding opposite edges of the sheets and thereof control the upstanding position of the sheets.

13. The hopper loader for transporting sheets in an edge-standing arrangement, as claimed in claim 10, wherein said second sheet-supporting conveyor is adapted to receive the deposit of sheets in the form of a bundle of sheets having a strap therearound, and including means on said second sheet-supporting conveyor for accommodating the removal of the strap off the bundle and away from said second sheet-supporting conveyor.

14. A method of moving sheets to a sheet hopper, comprising the steps of binding sheets into a bundle secured by a binding, manually placing/said bound bundle of sheets in an edge-standing arrangement onto an inclined sheet conveyor, restraining the opposite side edges of the sheets and supporting the sheets in the edge-standing arrangement on said conveyor, moving said conveyor with the sheets thereon into a horizontal orientation with the sheets standing on said conveyor in an upright edge-standing arrangement, removing said binding from said bundle, and moving the upright sheets off said conveyor and into a sheet-receiving conveyor and further moving the upright sheets into a hopper.

15. The method of moving sheets to a sheet hopper, as claimed in claim 14, including placing the bundle of sheets onto the inclined conveyor and against a backstop for holding the sheets upwardly.

16. The method of moving sheets to a sheet hopper, as claimed in claim 14, including the step of placing the bundle of sheets onto the inclined conveyor and against a movable backstop for holding the sheets upwardly, and moving said backstop along with the movement of said sheets off said conveyor.

* * * * *